US011268411B2

(12) United States Patent
Lu et al.

(10) Patent No.: US 11,268,411 B2
(45) Date of Patent: Mar. 8, 2022

(54) SYSTEM AND METHOD FOR ENGINE VALVE LASH CALIBRATION

(71) Applicant: Caterpillar Inc., Peoria, IL (US)

(72) Inventors: Yifeng Lu, Peoria, IL (US); Yanchai Zhang, Dunlap, IL (US); Zhaoxu Dong, Dunlap, IL (US); Nathan S. Pauli, Peoria, IL (US); Xuefei Hu, Dunlap, IL (US); Purna C. Nalla, Peoria, IL (US); Brian W. Young, Washington, IL (US); James D. Siegle, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/894,357

(22) Filed: Jun. 5, 2020

(65) Prior Publication Data

US 2021/0381401 A1 Dec. 9, 2021

(51) Int. Cl.
*F01L 1/22* (2006.01)
*F02B 77/08* (2006.01)
(Continued)

(52) U.S. Cl.
CPC ..... *F01L 1/22* (2013.01); *F02B 77/082* (2013.01); *G07C 5/008* (2013.01); *G07C 5/085* (2013.01);
(Continued)

(58) Field of Classification Search
CPC ... F01L 1/22; F01L 2201/00; F01L 2820/042; F02B 77/082; G07C 5/008; G07C 5/085
(Continued)

(56) References Cited

U.S. PATENT DOCUMENTS 3,988,925 A * 11/1976 Seccombe ..... F01L 1/20 73/114.79
6,474,283 B1 * 11/2002 Gidlund ..... F01L 1/26 123/90.45

(Continued)

FOREIGN PATENT DOCUMENTS

DE 3316588 C2 11/1983

OTHER PUBLICATIONS

Jiang, Zhinong et al. "Fault Diagnosis of Internal Combustion Engine Valve Clearance Using the Impact Commencement Detection Method," Sensors, 2017: 17: pp. 1-19.

(Continued)

*Primary Examiner* — Mahmoud Gimie
(74) *Attorney, Agent, or Firm* — Bookoff McAndrews PLLC

(57) ABSTRACT

A method for adjusting a valve lash in an internal combustion engine includes receiving a first signal generated by a sensor secured to the internal combustion engine, the first signal being indicative of a closing of a valve, receiving a second signal indicative of at least one of an engine speed of the internal combustion engine or a position of a camshaft of the internal combustion engine, and automatically determining an adjusted amount of lash associated with the valve based on the received first signal and the received second signal. The method also includes comparing the adjusted amount of lash to at least one predetermined threshold, and providing, in response to determining that the adjusted amount of lash is greater than the at least one predetermined threshold, a valve lash re-adjustment notification.

17 Claims, 4 Drawing Sheets

(51) Int. Cl.
*G07C 5/08* (2006.01)
*G07C 5/00* (2006.01)

(52) U.S. Cl.
CPC ..... *F01L 2201/00* (2013.01); *F01L 2820/042* (2013.01)

(58) Field of Classification Search
USPC ..... 123/350
See application file for complete search history.

(56) References Cited

U.S. PATENT DOCUMENTS

| | | | | |
|---|---|---|---|---|
| 9,933,334 | B2 | 4/2018 | Rivellini | |
| 10,563,545 | B2 | 2/2020 | Zhang | |
| 2002/0077762 | A1* | 6/2002 | Batchelor | F01L 1/20 702/94 |
| 2006/0288973 | A1* | 12/2006 | Hathaway | F01L 1/146 123/90.43 |
| 2016/0370254 | A1* | 12/2016 | Rivellini | F02D 41/0097 |
| 2019/0017487 | A1 | 1/2019 | Rudnitzki et al. | |
| 2019/0226416 | A1 | 7/2019 | Zurlo et al. | |
| 2019/0316496 | A1 | 10/2019 | Zhang et al. | |

OTHER PUBLICATIONS

Jafarian, Kamal et al. "Vibration Analysis for Fault Detection of Automobile Engine Using PCA Technique," 2016 4th International Conference on Control, Instrumentation, and Automation (ICCIA), 2016, pp. 372-376.

Written Opinion and International Search Report for Int'l. Patent Appln. No. PCT/US2021/035572, dated Sep. 29, 2021 (11 pgs).

* cited by examiner

SYSTEM AND METHOD FOR ENGINE VALVE LASH CALIBRATION

TECHNICAL FIELD

The present disclosure relates generally to internal combustion engine systems, and more particularly, to methods and systems for adjusting valve lash in an internal combustion engine.

BACKGROUND

Internal combustion engines are complex machines capable of outputting large amounts of power. In order to generate these large outputs, air and fuel systems must reliably supply precise amounts of air and fuel to combustion chambers of the engine at predetermined timings. A supply of air, with or without fuel, is periodically provided to the engine by intake valves of a valve train. Combustion products are exhausted from combustion chambers in a similar manner by exhaust valves of this valve train. In order to achieve desired operation of the engine, valve train components are designed with precise clearances. For example, a minor space or clearance may be provided between a rocker arm and a component of an engine valve, such as a valve stem (a component which may be actuated by the rocker arm to cause the valve to open and close). This clearance is generally referred to as valve lash. The position of a valve train component, such as the rocker arm, may be positioned during a valve lash calibration process in order to ensure that the valve lash is neither too "loose," a condition in which the clearance is excessively large, nor too "tight," a condition in which the clearance is too small (e.g., the rocker arm is positioned in contact with the valve stem such that the valve is unable to fully close).

Valve lash is typically evaluated at regular predetermined service intervals. However, these service intervals may be inadequate, and are generally scheduled either more frequently than necessary, which wastes resources, or less frequently than necessary, which may result in poor engine performance or even damage to the engine. In addition, manual valve lash calibration processes do not provide feedback to the operator. Thus, even when service is performed at the correct timing, it is possible for the operator to improperly set the valve lash. This improper setting may persist until the next scheduled service, and may cause increased wear. In some cases, improper valve setting may cause engine damage or even failure of the engine.

An exemplary valve lash detector for an engine is disclosed in U.S. Pat. No. 10,563,545 B2 to Zhang et al. (the '545 patent). The '545 patent describes a valve lash detector for detecting the presence of valve lash and determining a magnitude of the valve lash. While the valve lash detector described in the '545 patent may be useful, it may also be beneficial to provide a calibration system and method for providing an operator with an indication whether valve lash is acceptable, for example, during a calibration or adjustment of the valve lash, thereby facilitating automatic calibration of engine valve lash.

The disclosed method and system may solve one or more of the problems set forth above and/or other problems in the art. The scope of the current disclosure, however, is defined by the attached claims, and not by the ability to solve any specific problem.

SUMMARY

In one aspect, a method for adjusting a valve lash in an internal combustion engine may include receiving a first signal generated by a sensor secured to the internal combustion engine, the first signal being indicative of a closing of a valve, receiving a second signal indicative of at least one of an engine speed of the internal combustion engine or a position of a camshaft of the internal combustion engine, and automatically determining an adjusted amount of lash associated with the valve based on the received first signal and the received second signal. The method may also include comparing the adjusted amount of lash to at least one predetermined threshold, and providing, in response to determining that the adjusted amount of lash is greater than the at least one predetermined threshold, a valve lash re-adjustment notification.

In another aspect, a system for adjusting a valve lash in an internal combustion engine may include: at least one processor and at least one non-transitory computer readable medium storing instructions which, when executed by the one or more processors, cause the one or more processors to perform operations. The operations may include: receiving a first signal generated by a sensor secured to the internal combustion engine, the first signal being indicative of a closing of a valve, receiving a second signal indicative of at least one of an engine speed of the internal combustion engine or a position of a camshaft of the internal combustion engine, and automatically determining an adjusted amount of lash associated with the valve based on the received first signal and the received second signal. The operations may also include comparing the adjusted amount of lash to at least one predetermined threshold and providing, in response to determining that the adjusted amount of lash is greater than the at least one predetermined threshold, a valve lash re-adjustment notification.

In yet another aspect, a method for calibrating a valve lash in an internal combustion engine may include receiving a first signal indicative of a closing of a valve of the internal combustion engine following an adjustment in an amount of the valve lash in the internal combustion engine, receiving a second signal indicative of at least one of an engine speed of the internal combustion engine or a position of a camshaft of the internal combustion engine, and determining a magnitude of the adjusted amount of valve lash based on at least the received first signal and the received second signal. The method may also include comparing the magnitude of the adjusted amount of valve lash to a lash adjustment map and transmitting, based on the comparison between the magnitude of the adjusted amount of valve lash and the lash adjustment map, a valve lash re-adjustment notification.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion such that a process, method, article, or apparatus that comprises a list of elements does not include only those elements, but may include other elements not expressly listed or inherent to such a process, method, article, or apparatus. Moreover, in this disclosure, relative terms, such as, for example, "about," "substantially," "generally," and "approximately" are used to indicate a possible variation of ±10% in the stated value.

Figure 1:
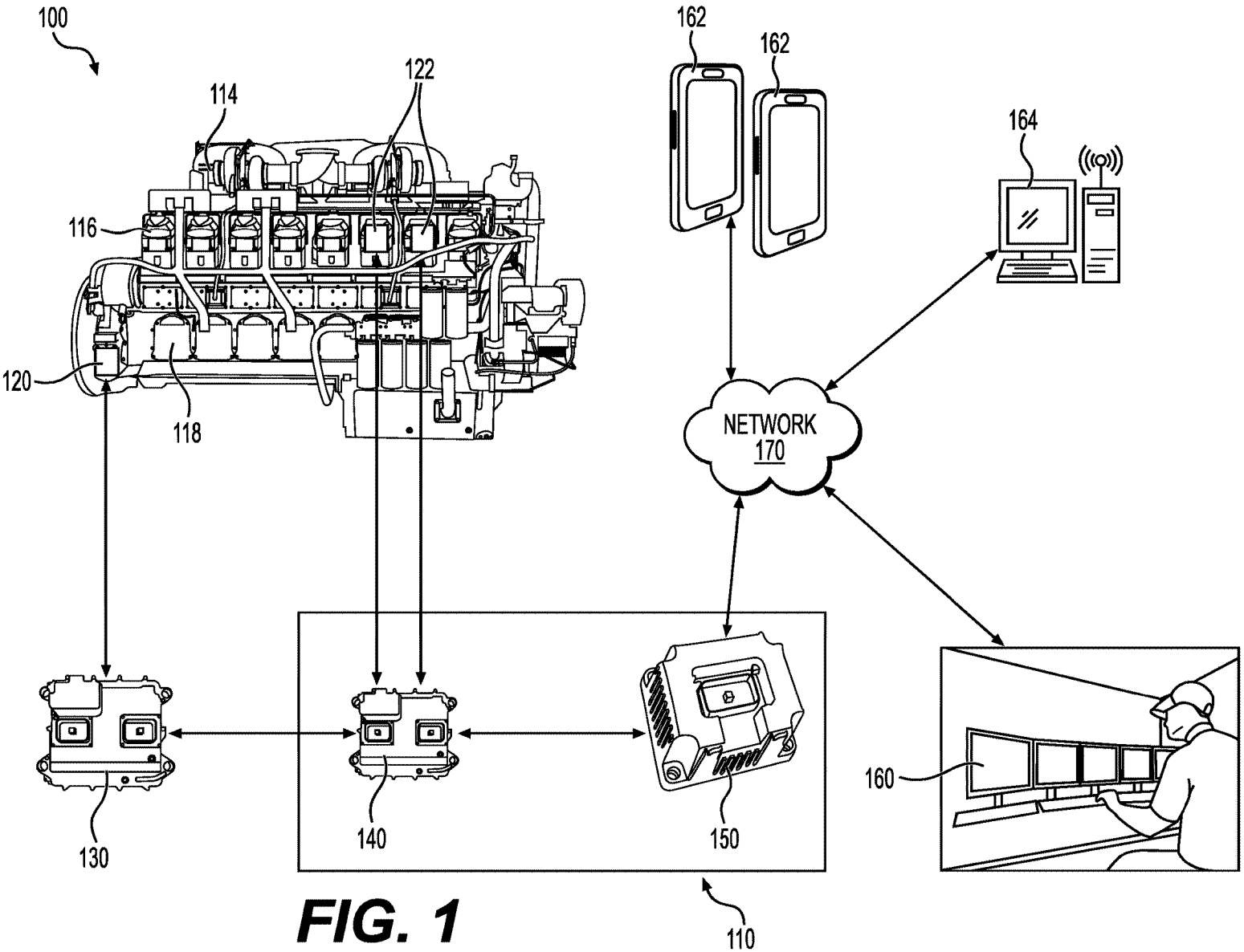
FIG. 1 is a diagram illustrating a valve lash calibration system according to an aspect of the present disclosure.

FIG. 1 is a diagram illustrating a valve lash autocalibration system or calibration system 100 for setting and adjusting valve lash in an internal combustion engine 114. Calibration system 100 may include internal combustion engine 114 and an engine valve monitoring system or kit 110 useful for monitoring valve lash, providing feedback regarding valve lash, updating a service record, and otherwise facilitating automatic valve calibration. Valve monitoring kit 110 may be used in combination with one or more remote components of calibration system 100, such as a back office system 160 and/or one or more servicer systems 164, which may communicate with one or more components of valve monitoring kit 110 via network 170. One or more components of calibration system 100, such as one or more user devices 162, may be local or remote, and may communicate with valve monitoring kit 110 via network 170. The back office system 160 and/or servicer systems 164 may comprise one or more servers or other cloud-connected devices. The servicer systems 164 and/or back office system 160 may communicate with the valve monitoring kit via network 170, and may process or otherwise provide data to other devices on network 170, such as to user devices 162.

Internal combustion engine 114 may be any suitable engine for mobile or stationary (e.g., power generation) applications. Engine 114 may be configured as a diesel engine, gasoline engine, or a gaseous fuel engine (e.g., capable of operating with use of one or more of natural gas, field gas, methane, propane, etc.). Engine 114 may be configured to operate as a dual fuel engine (e.g., an engine configured to operate with a gaseous fuel and diesel). Internal combustion engine 114 may include an engine head 116 and engine block 118 defining a plurality of cylinders with respective combustion chambers, pistons, intake valves, and exhaust valves. An engine valve train within engine 114 may be operably connected to the intake and exhaust valves of engine 114 to open and close respective valves for each cylinder. Engine 114 may also include an electronic control module (ECM) 130 configured to monitor and control one or more aspects of internal combustion engine 114 including one or more of a fuel delivery system, air delivery system, exhaust aftertreatment system, etc.

ECM 130 may be in operable communication with one or more sensors including intake sensors, engine temperature sensors, exhaust sensors, etc., configured to generate a signal indicative of an engine status. In particular, one or more engine speed sensors 120 may be configured to generate a signal indicative of an engine speed to ECM 130. Engine speed sensors 120 may include a sensor configured to detect and generate a signal indicative of a crankshaft speed, a camshaft speed, and/or a position (angular position) of a camshaft. While one exemplary speed sensor 120 (e.g., for a crankshaft) is illustrated in FIG. 1, as understood, a plurality of separate speed sensors 120 may be provided at various locations of engine 114 and may work in conjunction to provide, for example, speed and position information of one or more engine camshafts to ECM 130.

Engine valve monitoring kit 110 may include a lash evaluator 140, a network manager 150, and one or more sensors configured to generate a signal indicative of a closing of a valve of engine 114, such as vibration sensors 122. Lash evaluator 140 may be in communication with each of the vibration sensors 122, ECM 130, and network manager 150. Lash evaluator 140 may include one or more signal processing circuits configured to perform high-frequency data analysis and preprocessing. For example, lash evaluator 140 may include a field programmable gate array (FPGA) to facilitate processing and/or analysis of vibration signals generated by one or more of the vibration sensors 122, as well as speed and/or camshaft position information received from speed sensors 120.

In an exemplary configuration, lash evaluator 140 may include a plurality of processing units, such as a relatively fast processing unit (e.g., an FPGA) and a relatively slow processing unit (e.g., a processor). The faster processing unit may be configured for analog to digital signal conversion of engine speed, camshaft position, and/or vibration signals at a suitable sampling rate, such as 100 kHz. A suitable FPGA or other processing unit may be configured to apply signal processing techniques such as engine speed and/or timing monitoring, filtering (bandpass filtering, lowpass filtering), envelope detection, absolute value return, windowing (e.g., identifying values indicative of valve closing at a desired crank angle/camshaft position), and trigger-based reporting. Trigger-based reporting may include detecting when an envelope crosses a predetermined threshold. Additionally, such reporting may include identifying and reporting a maximum (peak) envelope amplitude, within a predetermined window, and adjusting the predetermined threshold based on the maximum identified amplitude. Thus, lash evaluator 140 may be configured to identify valve closing events when the vibration signal exceeds a threshold, and may determine the timing of the valve closure based on the peak of the vibration signal, by evaluating an envelope of the signal. Moreover, evaluator 140 may be configured to adjust the threshold, if necessary, in proportion to this peak to improve the accuracy of the valve closure detection process. The FPGA may further be configured to set a flag (e.g., in a memory of lash evaluator 140) when a valve closing event is identified (e.g., when the amplitude of the vibration signal exceeds a predetermined threshold).

The slower processing unit or processor of lash evaluator 140 may be in communication with the faster processing unit or FPGA, and may be configured to evaluate valve closing events identified or flagged by the FPGA. For example, the processor may be configured to ignore valve closing events that occur when the engine speed is outside of a predetermined speed (e.g., RPM) range. The processor may further be configured to perform smoothing on the received signals, including the vibration signal, and generate new data based on the smoothed results. For example, by smoothing a vibration signal, the processor may calculate and track a median value of this signal, which may reduce the influence of outliers (e.g., vibrations caused by events other than the closing of a valve). Additionally, the processor may adjust thresholds for identifying a valve closing event, such that the thresholds are proportional to a peak value identified in the smoothed vibration signal. The processor may identify a magnitude of valve lash based on one or more maps (e.g., maps corresponding to respective cold and warm conditions of engine 114), and determine whether lash is within an acceptable range, a range indicative that valve lash requires adjustment (or further adjustment), or at a level that requires that engine 114 be shut down, as described below.

Network manager 150 may include one or more network or communication interfaces configured to enable communication with one or more back office systems, user devices 162, and servicer system 164. In an exemplary configuration, network manager 150 may include one or more telematics devices and may be configured to low-frequency data analysis and/or static information analysis. While lash evaluator 140 and network manager 150 are shown as separate devices in FIG. 1, lash evaluator 140 and network manager 150 may be combined and/or provided as components of a single device. Additionally, one or both of lash evaluator 140 and network manager 150 may be combined with (e.g., incorporated within) ECM 130.

Vibration sensors 122 may be provided on engine head 116 or engine block 118 at any suitable position that enables detection of vibration generated when a valve of a particular cylinder closes. For example, vibration sensors 122 may be configured to detect the vibration caused by an impact between a valve and a valve seat. While two vibration sensors 122 are illustrated in FIG. 1 for a respective pair of engine cylinders, engine valve calibration system 100 may include one or more vibration sensors 122 for each cylinder of engine 114. Including a respective vibration sensor 122 for each cylinder may facilitate the ability to calibrate and/or monitor valve lash in each cylinder of engine 114.

One or more back office systems 160 may be configured to communicate with network manager 150 via network 170 to establish and update a service record for valve lash of engine 114. For example, back office systems 160 may monitor, via the service record, a status of valve lash for one or more cylinders of engine 114. In an exemplary embodiment, the service record may store a historical record of valve lash for each cylinder of engine 114, as well as a current value of valve lash, which may tend to change (e.g., tighten as the valve recedes due to wear). Thus, back office systems 160, or other server or cloud device, may be configured to present and/or analyze trends and thereby predict when a valve service will be necessary in the future. If desired, back office systems 160 may monitor a plurality of engines 114 via a plurality of valve monitoring kits 110. Thus, a fleet of machines having a respective plurality of engines 114 may be monitored via back office systems 160.

Network manager 150 may communicate with one or more user devices 162 in a manner similar to the communication with back office systems 160. In some embodiments, user devices 162 may be used by, for example, a technician or operator, during a valve lash adjustment procedure. User devices 162, when present on-site with engine 114 may, for example, allow valve monitoring kit 110 to provide real-time, immediate feedback regarding valve lash during calibration, thereby facilitating autocalibration of the valves of engine 114.

In addition to back office 160 and user devices 162, which may facilitate real-time monitoring of engine 114 by owners, technicians, operators, or other users, calibration system 100 may include one or more servicer systems 164 that may receive real-time lash information via network 170. Servicer systems 164 may correspond to one or more third-party (e.g., dealer) systems. By providing lash information to servicer systems 164, current and/or historic lash monitoring may be possible. Thus, in a manner similar to back office 160, servicer systems 164 may facilitate real-time monitoring to determine when a service is necessary, as well as develop predictions (e.g., based on a service record of historical valve lash values) for when a valve service will be necessary in the future. In one aspect, a valve lash adjustment procedure for servicing engine 114 may be scheduled automatically by calibration system 100 based on these predictions.

Figure 2:
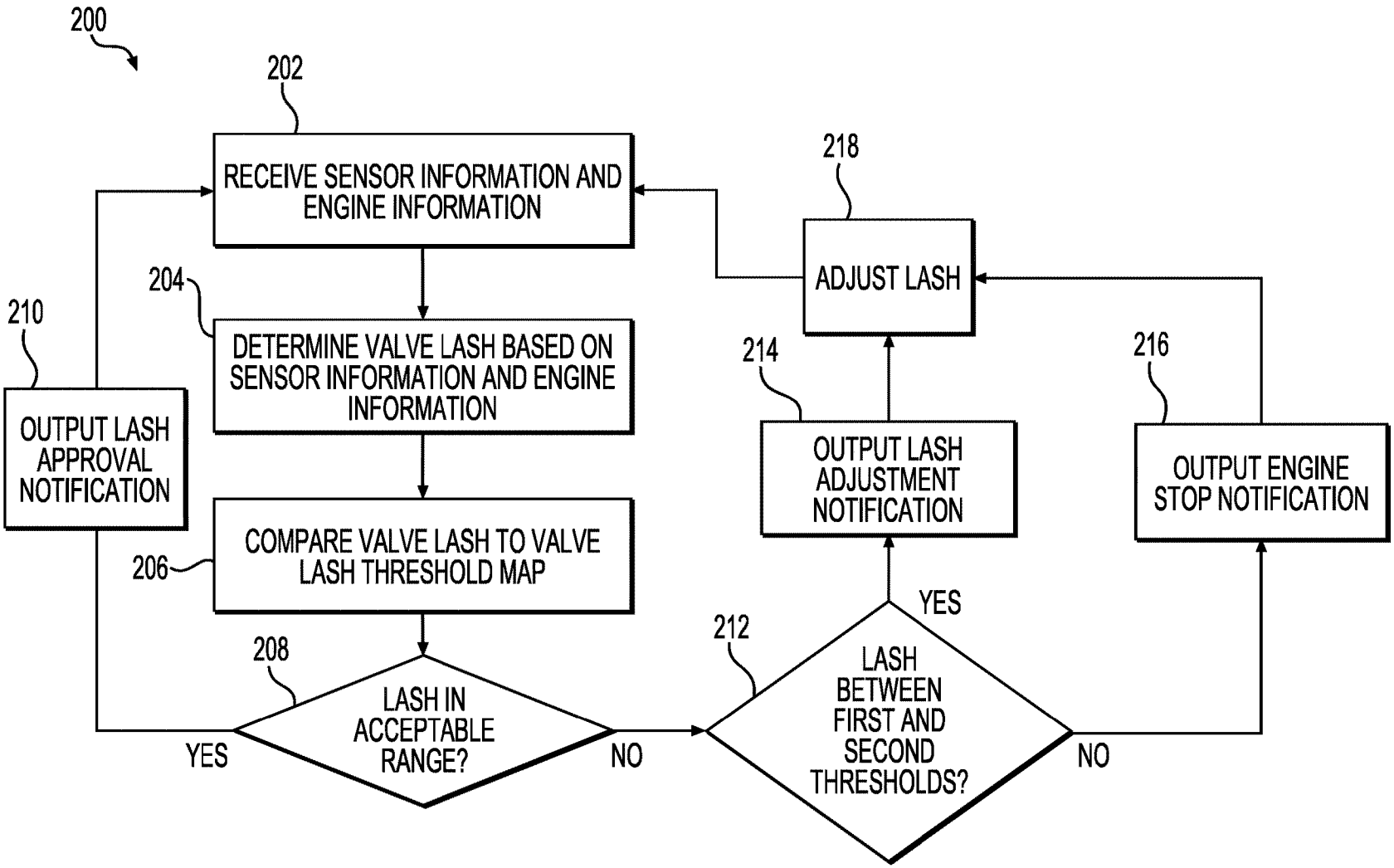
FIG. 2 is flowchart illustrating an exemplary method for valve lash calibration, according to aspects of the present disclosure.

FIG. 2 is a flowchart illustrating an exemplary method 200 that may be performed for calibrating or adjusting valve lash in an internal combustion engine such as engine 114. While method 200 may be performed as part of an autocalibration process for valve lash in engine 114, method 200 may additionally or alternatively be employed for monitoring lash after servicing (e.g., between service intervals). As part of a valve autocalibration process, method 200 may be performed following an initial valve lash setting of an adjustment process.

At a step 202, sensor information and engine information may be received. For example, an engine status signal indicative of at least one of an engine speed or a position of a camshaft may be received by evaluator 140. Step 202 may include the generation of an engine speed signal from one or more engine speed sensors 120, which is transmitted to ECM 130. ECM 130 may, in turn, generate a signal indicative of the speed of engine 114, and output this signal to evaluator 140. Alternatively, speed sensor(s) 120 may communicate directly with evaluator 140, and provide these signal(s) to evaluator 140.

In some embodiments, a position of a camshaft may be determined based on one or more camshaft position sensors in communication with ECM 130. Alternatively, ECM 130 may be configured to determine a position of a camshaft based on speed sensors 120 and based on a known initial position of the camshaft. Regardless of how camshaft position is determined, ECM 130 may provide a signal indicative of the position of a camshaft to evaluator 140. If desired, lash evaluator 140 may itself communicate with one or more sensors and determine a position of the camshaft.

Step 202 may also include receiving one or more signals indicative of a closing of an engine valve, such as a vibration signal. In the exemplary configuration illustrated in FIG. 1, evaluator 140 may receive respective vibration signals from a plurality of vibration sensors 122. For example, evaluator 140 may receive at least one vibration signal associated with a particular cylinder of engine 114. In some aspects, a vibration signal is generated by respective vibration sensors 122 for every individual cylinder of engine 114.

In a step 204, valve lash may be determined based on received sensor information and received engine information, including the information received in step 202. Step 204 may include determining valve lash based on engine speed, camshaft position, and at least one vibration signal from vibration sensors 122. Step 204 may include determining valve lash for a single valve or for one or more valves associated with every cylinder of engine 114.

Lash evaluator 140 may be configured to determine an actual valve closing timing based on the vibration signal from a vibration sensor 122 associated with the valve. Valve lash may be determined by first identifying a valve closing event, which may be performed by determining when an envelope of a vibration signal exceeds a predetermined threshold, as described above, and determining a timing of a peak of the envelope. In particular, the amount of valve lash may be determined based on a timing at which a vibration (e.g., a peak) generated by a closing valve is detected, and the corresponding position of the camshaft at this timing. If desired, the amount of valve lash may also take into account the amplitude of the vibration signal, which may be indicative of the velocity of the closing engine valve. When so configured, lash evaluator 140 may determine the amount of valve lash based on a relationship between engine speed and engine valve velocity, in addition to the timing of the vibration signal.

In a step 206, the amount (e.g., magnitude) of valve lash determined in step 204 may be compared to one or more maps or lookup tables. For example, an amount of valve lash may be compared to a lookup table containing a plurality of predetermined thresholds and/or ranges, collectively referred to as "lash categories." These lash categories may each correspond to, for example, an acceptable amount of valve lash, an amount of lash that requires valve lash adjustment (an exemplary first predetermined threshold), and an amount of lash that requires shutting down engine 114 (an exemplary second predetermined threshold associated with potential damage to engine 114). In some aspects, a lash category may be associated with valve lash that is "loose" (which may be indicated by an advanced or early closing of the valve and a delayed opening of the valve). Similarly, a lash category may be associated with valve lash that is "tight" (which may be associated with delayed and/or incomplete closure of the valve).

In one aspect, the predetermined thresholds and/or ranges of each lash category may correspond to either a cold condition of the engine 144 (e.g., during a cold start of engine before a temperature of engine 114 reaches a predetermined operating temperature) or a warm condition of the engine 114 associated with a predetermined temperature or range of temperatures associated with a steady-state or "warmed-up" operation of engine 114. Thus, a plurality of lash categories may belong to a map for a cold condition of engine 114 or to a map for a warm condition of engine 114. Lash evaluator 140 may determine the condition of engine 114, and determine which map is appropriate, based on a temperature detected by a temperature sensor associated with engine 114. The temperature sensor may generate a temperature signal to ECM 130 and/or evaluator 140, in step 202, for example.

A step 208 may include determining whether the amount of valve lash is within a predetermined acceptable range, and may be performed during valve lash adjustment. In at least some engines, the predetermined range may be associated with a desired amount of valve lash that is greater than zero. However, in some engines, such as engines including a hydraulic lash adjuster, the predetermined range may represent an allowable deviation from zero. Step 208 may be performed for a single valve or for one or more valves associated with one or more cylinders of engine 114.

When the determination in step 208 is indicative of valve lash that is within a predetermined acceptable range, a step 210 may be performed. In step 210, a lash approval notification indicative of an acceptable amount of valve lash may be output, e.g., by evaluator 140. This notification may include one or more of a visual or audio notification that indicates that the valve lash, which may be an adjust amount of valve lash during a calibration procedure, is acceptable. In one aspect, step 210 may include providing a "green light" or other approval indicator on a display, such as a display of a user device 162, a display connected to or provided as part of engine valve monitoring kit 110, and/or a display secured to or in proximity of engine 114 for monitoring the operation of engine 114. This notification may also identify a particular cylinder (e.g., by location) and/or particular valve (e.g., an exhaust valve) of engine 114. Thus, an operator performing a valve lash calibration may be provided with feedback for one or more valves.

When the determination in step 208 is negative, the valve lash may be determined to be outside the acceptable range. A step 212 may then be performed to determine whether the valve lash is between first and second predetermined thresholds. These predetermined thresholds may define a predetermined range in which valve lash adjustment is required.

When valve lash is within such a range, the determination in step 212 may be affirmative, and a step 214 is performed to provide a valve lash re-adjustment notification. Step 214 may include providing a suitable notification in any suitable form, as described above with respect to step 210. This notification may be indicative of a need to re-adjust the valve lash in one or more valves of engine 114, and may include providing a "yellow light" or other warning indicator on a display. The notification may identify a particular cylinder and/or a particular valve in a manner similar to the notification described with respect to step 210. If desired, the notification may indicate whether the valve lash is excessive ("loose"), or insufficient ("tight").

When the determination in step 212 is negative (the valve lash is not within the predetermined acceptable range and is not between the first and second predetermined thresholds), the amount of valve lash calculated by evaluator 140 may exceed the second predetermined threshold. Such a valve lash may be capable of causing damage to engine 114. Therefore, in a step 216, a valve lash re-adjustment notification may include an engine stop notification that is presented to the operator. For example, an engine stop notification may be presented by providing a "red light," textual, audio, and/or other warning to stop operation of engine 114 immediately. The notification may identify a particular valve and/or particular cylinder, as described above. If desired, evaluator 140 may provide a signal to ECM 130 to facilitate automated shut-down of engine 114. Thus, engine 114 may cease operation in an automated manner when excessive valve lash is detected during a valve lash adjustment.

Following step 214 or step 216, a step 218 may include adjusting or re-adjusting the valve lash. For example, the operator may re-adjust the position of one or more components of a valve train of engine 114, such as a rocker arm. This adjustment may be performed, by an operator, on the valve identified in the notification issued in step 214 or 216. In one aspect, the adjustment may be performed based on information included in the notification, such as a magnitude of valve lash, an identification of the valve and/or cylinder, and information indicative of whether the valve lash should be increased or decreased. Following step 218, method 200 may return to step 202. Each step of method 200 may be repeated one or more times during a valve lash adjustment operation (e.g., during servicing of engine 114).

Each of the notifications described above with respect to steps 210, 214, and 216 may be output by a display of any one of evaluator 140 (e.g., via a display associated with engine 114), back office 160, user devices 162, and/or servicer system 164. Steps 202-218 may be repeated as often as necessary during valve lash adjustment to adjust, re-adjust, and/or evaluate valve lash for each valve of internal combustion engine 114. An operator may be provided with immediate feedback, during calibration, regarding the adjustment for each valve based on which notification (e.g., of the notifications in steps 210, 214, and 216) is presented.

Figure 3:
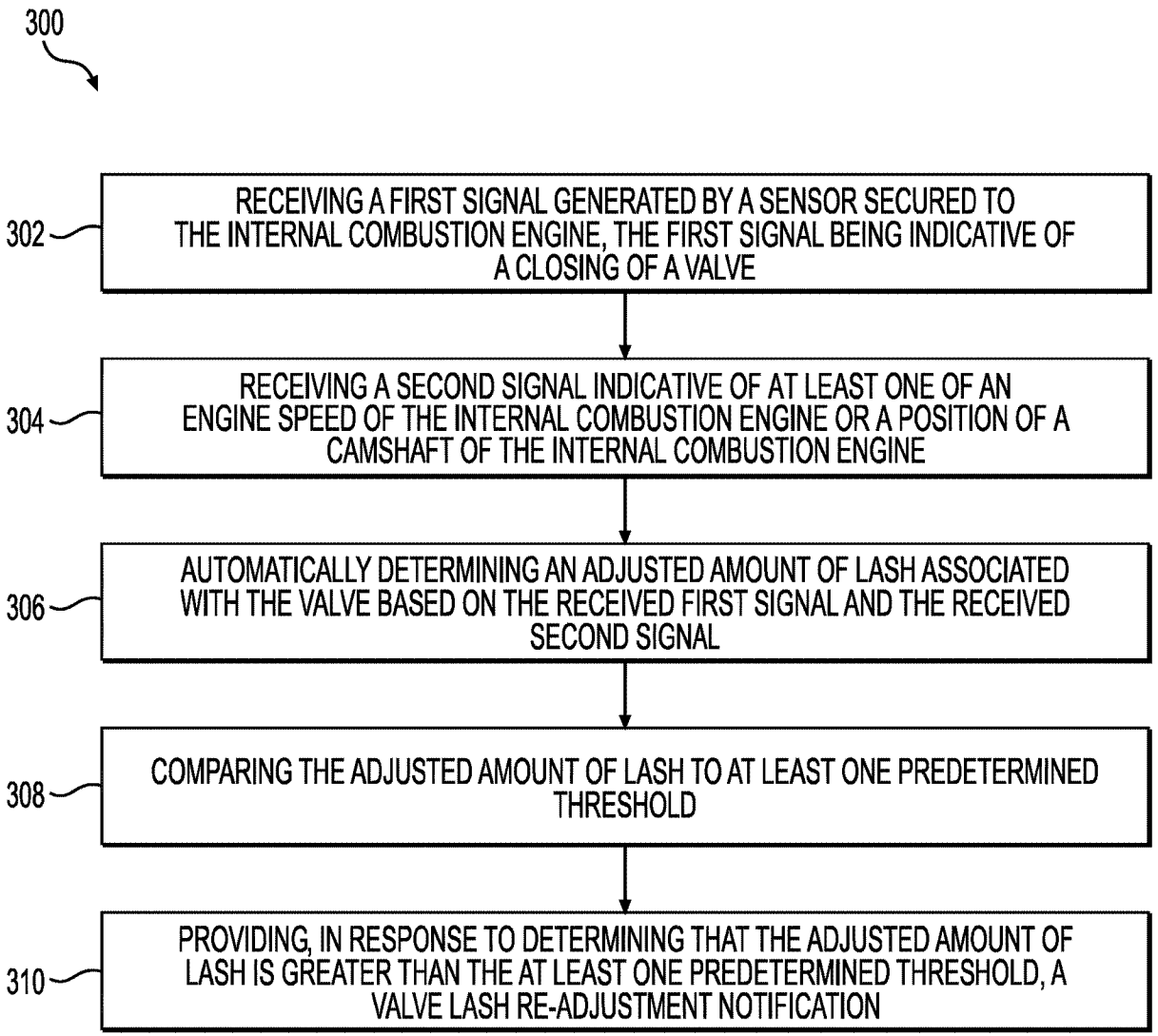
FIG. 3 is a flowchart illustrating an exemplary method of valve lash calibration, according to aspects of the present disclosure.

FIG. 3 is a flowchart of an exemplary method 300 according to aspects of the present disclosure. Method 300, like method 200, may be performed as part of and/or during, a service operation for adjusting valve lash, and may begin following an initial valve lash adjustment. In a step 302, a first signal may be received, for example, by lash evaluator 140. The first signal may be generated by one or more vibration sensors 122 secured to internal combustion engine 114. The signal generated by sensor(s) 122 may be indicative of, for example, a closing of a valve of engine 114.

A step 304 may include receiving a second signal that indicates an engine speed, a position of a camshaft, or both. The second signal may be generated by ECM 130 and provided to lash evaluator 140, for example.

Step 306 may include automatically determining an adjusted amount of valve lash associated with one or more valves of engine 114. For example, adjusted amount the valve lash may be determined based on the first signal and the second signal received, for example, by lash evaluator 140.

Step 308 may include comparing the adjusted amount of valve lash with at least one predetermined threshold. For example, the adjusted amount of valve lash may be compared, by lash evaluator 140, to a plurality of predetermined thresholds stored in a map. The predetermined thresholds may define, for example, a predetermined range associated with an acceptable or desired amount of valve lash (which may include zero valve lash), a predetermined range associated with an unacceptable amount of valve lash that requires re-adjustment of the valve lash, and a predetermined threshold that, when exceeded, may cause damage to engine 114 and is associated with a need to stop engine 114 and re-adjust the valve lash.

Based on the comparison performed in step 308, step 310 may include providing a notification. The notification may be a valve lash re-adjustment notification provided in response to determining that the adjusted amount of valve lash is greater than the at least one predetermined threshold.

Figure 4:
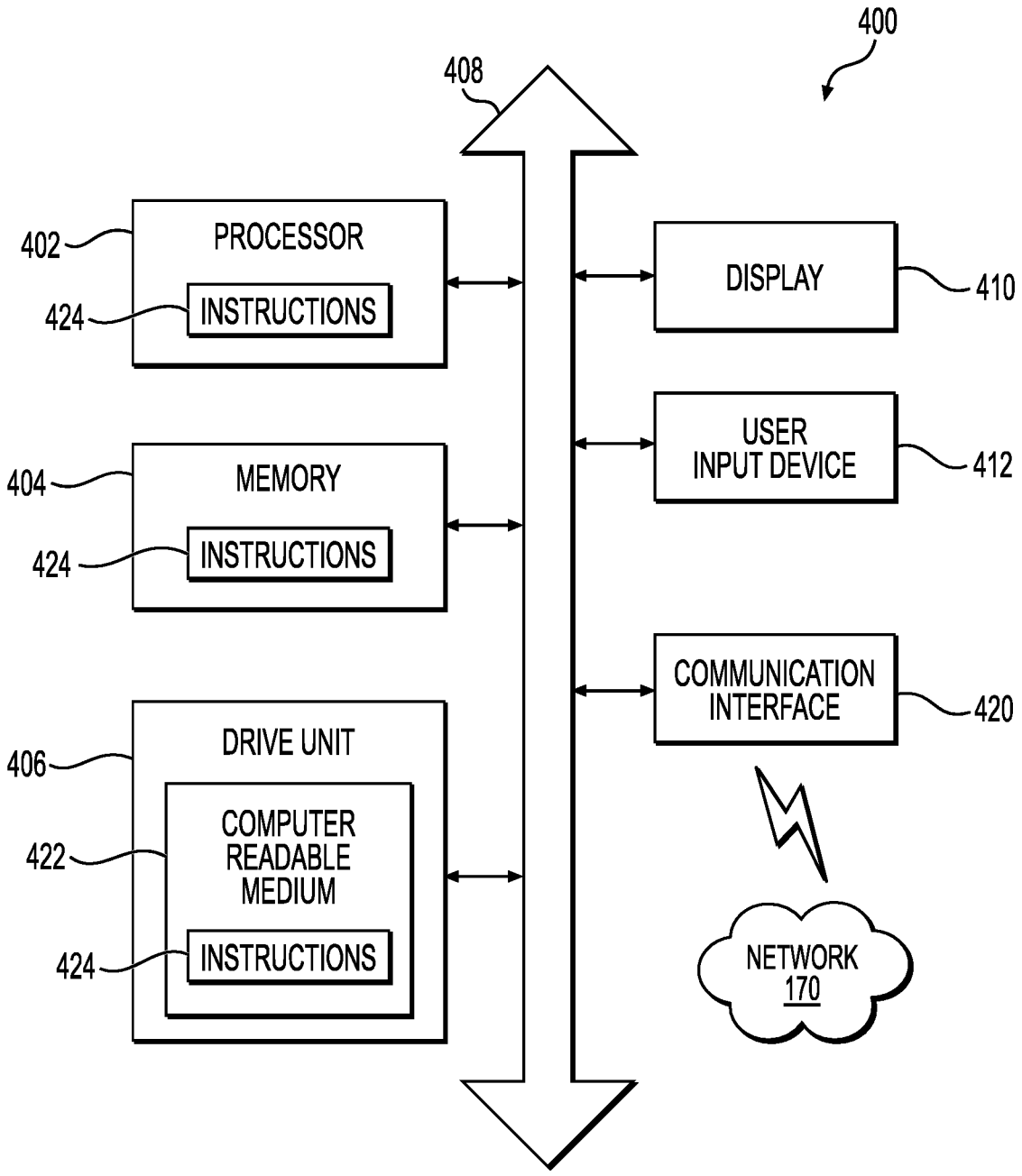
FIG. 4 is a block diagram illustrating an implementation of a computer system that may execute techniques according to aspects of the present disclosure.

FIG. 4 illustrates an implementation of a computer system 400, which may correspond to ECM 130, lash evaluator 140, network manager 150, back office systems 160, user devices 162, and/or servicer systems 164, as well as other device(s) useful in system 100. The computer system 400 can include a set of instructions that can be executed to cause the computer system 400 to perform any one or more of the methods or computer based functions disclosed herein. The computer system 400 may operate as a standalone device or may be connected, e.g., using a network, to other computer systems or peripheral devices.

In a networked deployment, the computer system 400 may operate in the capacity of a server or as a client user computer in a server-client user network environment, or as a peer computer system in a peer-to-peer (or distributed) network environment. The computer system 400 can also be implemented as or incorporated into various devices, such as a personal computer (PC), a tablet PC, a set-top box (STB), a personal digital assistant (PDA), a mobile device, a palmtop computer, a laptop computer, a desktop computer, a communications device, a wireless telephone, a land-line telephone, a control system, a camera, a scanner, a facsimile machine, a printer, a pager, a personal trusted device, a web appliance, a network router, switch or bridge, or any other machine capable of executing a set of instructions (sequential or otherwise) that specify actions to be taken by that machine. In a particular implementation, the computer system 400 can be implemented using electronic devices that provide voice, video, or data communication. Further, while a single computer system 400 is illustrated, the term "system" shall also be taken to include any collection of systems or sub-systems that individually or jointly execute a set, or multiple sets, of instructions to perform one or more computer functions.

As illustrated in FIG. 4, the computer system 400 may include a processor 402, e.g., a central processing unit (CPU), a graphics processing unit (GPU), or both. The processor 402 may be a component in a variety of systems. For example, the processor 402 may be part of a standard personal computer or a workstation. The processor 402 may be one or more general processors, digital signal processors, application specific integrated circuits, field programmable gate arrays, servers, networks, digital circuits, analog circuits, combinations thereof, or other now known or later developed devices for analyzing and processing data. The processor 402 may implement a software program, such as code generated manually (i.e., programmed).

The computer system 400 may include a memory 404 that can communicate via a bus 408. The memory 404 may be a main memory, a static memory, or a dynamic memory. The memory 404 may include, but is not limited to, computer readable storage media such as various types of volatile and non-volatile storage media, including but not limited to random access memory, read-only memory, programmable read-only memory, electrically programmable read-only memory, electrically erasable read-only memory, flash memory, magnetic tape or disk, optical media and the like. In one implementation, the memory 404 includes a cache or random-access memory for the processor 402. In alternative implementations, the memory 404 is separate from the processor 402, such as a cache memory of a processor, the system memory, or other memory. The memory 404 may be an external storage device or database for storing data. Examples include a hard drive, compact disc ("CD"), digital video disc ("DVD"), memory card, memory stick, floppy disc, universal serial bus ("USB") memory device, or any other device operative to store data. The memory 404 is operable to store instructions executable by the processor 402. The functions, acts or tasks illustrated in the figures or described herein may be performed by the programmed processor 402 executing the instructions stored in the memory 404. The functions, acts or tasks are independent of the particular type of instructions set, storage media, processor or processing strategy and may be performed by software, hardware, integrated circuits, firm-ware, micro-code and the like, operating alone or in combination. Likewise, processing strategies may include multiprocessing, multitasking, parallel processing and the like.

As shown, the computer system 400 may further include a display 410, such as a liquid crystal display (LCD), an organic light emitting diode (OLED), a flat panel display, a solid-state display, a cathode ray tube (CRT), a projector, a printer or other now known or later developed display device for outputting determined information. The display 410 may act as an interface for a user, to see the functioning of the processor 402, or specifically as an interface with the software stored in the memory 404 or in the drive unit 406.

Additionally or alternatively, the computer system 400 may include an input device 412 configured to allow a user to interact with any of the components of system 400. The input device 412 may be a number pad, a keyboard, or a cursor control device, such as a mouse, or a joystick, touch screen display, remote control, or any other device operative to interact with the computer system 400.

The computer system 400 may also or alternatively include a disk or optical drive unit 406. The disk drive unit 406 may include a computer-readable medium 422 in which one or more sets of instructions 424, e.g. software, can be embedded. Further, the instructions 424 may embody one or more of the methods or logic as described herein. The instructions 424 may reside completely or partially within the memory 404 and/or within the processor 402 during execution by the computer system 400. The memory 404 and the processor 402 also may include computer-readable media as discussed above.

In some systems, a computer-readable medium 422 includes instructions 424 or receives and executes instructions 424 responsive to a propagated signal so that a device connected to a network 170 can communicate voice, video, audio, images, or any other data over the network 170. Further, the instructions 424 may be transmitted or received over the network 170 via a communication port or interface 420, and/or using a bus 408. The communication port or interface 420 may be a part of the processor 402 or may be a separate component. The communication port 420 may be created in software or may be a physical connection in hardware. The communication port 420 may be configured to connect with a network 170, external media, the display 410, or any other components in computer system 400, or combinations thereof. The connection with the network 170 may be a physical connection, such as a wired Ethernet connection or may be established wirelessly as discussed below. Likewise, the additional connections with other components of the computer system 400 may be physical connections or may be established wirelessly. The network 170 may alternatively be directly connected to the bus 408.

While the computer-readable medium 422 is shown to be a single medium, the term "computer-readable medium" may include a single medium or multiple media, such as a centralized or distributed database, and/or associated caches and servers that store one or more sets of instructions. The term "computer-readable medium" may also include any medium that is capable of storing, encoding, or carrying a set of instructions for execution by a processor or that cause a computer system to perform any one or more of the methods or operations disclosed herein. The computer-readable medium 422 is non-transitory, and may be tangible.

The computer-readable medium 422 can include a solid-state memory such as a memory card or other package that houses one or more non-volatile read-only memories. The computer-readable medium 422 can be a random-access memory or other volatile re-writable memory. Additionally or alternatively, the computer-readable medium 422 can include a magneto-optical or optical medium, such as a disk or tapes or other storage device to capture carrier wave signals such as a signal communicated over a transmission medium. A digital file attachment to an e-mail or other self-contained information archive or set of archives may be considered a distribution medium that is a tangible storage medium. Accordingly, the disclosure is considered to include any one or more of a computer-readable medium or a distribution medium and other equivalents and successor media, in which data or instructions may be stored.

In an alternative implementation, dedicated hardware implementations, such as application specific integrated circuits, programmable logic arrays and other hardware devices, can be constructed to implement one or more of the methods described herein. Applications that may include the apparatus and systems of various implementations can broadly include a variety of electronic and computer systems. One or more implementations described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

The computer system 400 may be connected to one or more networks 170. The network 170 may define one or more networks including wired or wireless networks. The wireless network may be a cellular telephone network, an 802.11, 802.16, 802.20, or WiMax network. Further, such networks may include a public network, such as the Internet, a private network, such as an intranet, or combinations thereof, and may utilize a variety of networking protocols now available or later developed including, but not limited to TCP/IP based networking protocols. The network 170 may include wide area networks (WAN), such as the Internet, local area networks (LAN), campus area networks, metropolitan area networks, a direct connection such as through a Universal Serial Bus (USB) port, or any other networks that may allow for data communication. The network 170 may be configured to couple one computing device to another computing device to enable communication of data between the devices. The network 170 may generally be enabled to employ any form of machine-readable media for communicating information from one device to another. The network 170 may include communication methods by which information may travel between computing devices. The network 170 may be divided into sub-networks. The sub-networks may allow access to all of the other components connected thereto or the sub-networks may restrict access between the components. The network 170 may be regarded as a public or private network connection and may include, for example, a virtual private network or an encryption or other security mechanism employed over the public Internet, or the like.

INDUSTRIAL APPLICABILITY

During an engine valve lash calibration procedure, a technician or operator may adjust one or more valve train components of engine 114 to achieve a desired amount (or absence of) valve lash. During an engine valve calibration procedure, one or more components of engine valve calibration system 100 may automate the calibration process and provide feedback to the operator in real time. For example, following an adjustment in the valve lash of one or more valves of engine 114, one or more components of engine valve monitoring kit 110 may generate, transmit, display, or otherwise provide real-time feedback as a notification indicative of whether the valve lash is acceptable, the valve lash exceeds a first predetermined threshold in a map, or the valve lash exceeds a second predetermined threshold in a map. Additionally, calibration system 100 may monitor valve lash during an operation of engine 114 between services, and may provide a notification indicative of a need to adjust valve lash and/or discontinue use of engine 114 in accordance with this real-time operation of engine 114.

In at least some aspects, by providing sensors and appropriate notifications, it may be possible to prevent an operator from incorrectly setting valve lash. Thus, the valve adjustment may be performed substantially free of human error. For example, a notification may, in an automated manner, provide feedback to the operator indicative of whether valve lash should be corrected (e.g., further adjusted) for one or more valves of engine 114. Once the valve lash is corrected, the notification may indicate that the amount of valve lash is acceptable, and identify which valves do not require re-adjustment, as well as identify any valves that do require re-adjustment. Additionally, the methods and systems described herein may facilitate automatic scheduling of valve lash adjustment. By monitoring changes in valve lash over time, it may also be possible to predict when service will be necessary and/or monitor valve recession, without the need to disassemble the engine, inspect valve components manually, and re-assemble the engine. By communicating with user devices or other devices, it may be possible to ensure that valve lash is monitored in an accurate and timely manner, even for a fleet of machines or vehicles.

In accordance with various implementations of the present disclosure, the methods described herein may be implemented by software programs executable by a computer system. Further, in an exemplary, non-limited implementation, implementations can include distributed processing, component/object distributed processing, and parallel processing. Alternatively, virtual computer system processing can be constructed to implement one or more of the methods or functionality as described herein.

Although the present specification describes components and functions that may be implemented in particular implementations with reference to particular standards and protocols, the disclosure is not limited to such standards and protocols. For example, standards for Internet and other packet switched network transmission (e.g., TCP/IP, UDP/IP, HTML, HTTP) represent examples of the state of the art. Such standards are periodically superseded by faster or more efficient equivalents having essentially the same functions. Accordingly, replacement standards and protocols having the same or similar functions as those disclosed herein are considered equivalents thereof.

It will be understood that the steps of methods discussed are performed in one embodiment by an appropriate processor (or processors) of a processing (i.e., computer) system executing instructions (computer-readable code) stored in storage. It will also be understood that the disclosure is not limited to any particular implementation or programming technique and that the disclosure may be implemented using any appropriate techniques for implementing the functionality described herein. The disclosure is not limited to any particular programming language or operating system.

It should be appreciated that in the above description of exemplary embodiments, various features are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claims require more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment.

Furthermore, while some embodiments described herein include some but not other features included in other embodiments, combinations of features of different embodiments are meant to be within the scope of the disclosure, and form different embodiments, as would be understood by those skilled in the art. For example, in the following claims, any of the claimed embodiments can be used in any combination.

Furthermore, some of the embodiments are described herein as a method or combination of elements of a method that can be implemented by a processor of a computer system or by other means of carrying out the function. Thus, a processor with the necessary instructions for carrying out such a method or element of a method forms a means for carrying out the method or element of a method. Furthermore, an element described herein of an apparatus embodiment is an example of a means for carrying out the function performed by the element for the purpose of carrying out the disclosure.

In the description provided herein, numerous specific details are set forth. However, it is understood that embodiments may be practiced without these specific details. In other instances, well-known methods, structures and techniques have not been shown in detail in order not to obscure an understanding of this disclosure.

Thus, while there has been described what are believed to be the preferred embodiments, those skilled in the art will recognize that other and further modifications may be made thereto without departing from the spirit of the disclosure, and it is intended to claim all such changes and modifications as falling within the scope of the disclosure. For example, any formulas given above are merely representative of procedures that may be used. Functionality may be added or deleted from the block diagrams and operations may be interchanged among functional blocks. Steps may be added or deleted to methods described within the scope of the present disclosure.

The above disclosed subject matter is to be considered illustrative, and not restrictive, and the appended claims are intended to cover all such modifications, enhancements, and other implementations, which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description. While various implementations of the disclosure have been described, it will be apparent to those of ordinary skill in the art that many more implementations and implementations are possible within the scope of the disclosure. Accordingly, the disclosure is not to be restricted except in light of the attached claims and their equivalents.

The general discussion of this disclosure provides a brief, general description of a suitable computing environment in which the present disclosure may be implemented. In one embodiment, any of the disclosed systems, methods, and/or graphical user interfaces may be executed by or implemented by a computing system consistent with or similar to that depicted and/or explained in this disclosure. Although not required, aspects of the present disclosure are described in the context of computer-executable instructions, such as routines executed by a data processing device, e.g., a programmed controller or computer. Those skilled in the relevant art will appreciate that aspects of the present disclosure can be practiced with other communications, data processing, or computer system configurations, including: Internet appliances, hand-held devices, etc.

Aspects of the present disclosure may be embodied in a special purpose computer and/or data processor that is specifically programmed, configured, and/or constructed to perform one or more of the computer-executable instructions explained in detail herein. While aspects of the present disclosure, such as certain functions, are described as being performed exclusively on a single device, the present disclosure may also be practiced in distributed environments where functions or modules are shared among disparate processing devices. Similarly, techniques presented herein as involving multiple devices may be implemented in a single device. In a distributed computing environment, program modules may be located in both local and/or remote memory storage devices.

Aspects of the present disclosure may be stored and/or distributed on non-transitory computer-readable media, including magnetically or optically readable computer discs, hard-wired or preprogrammed chips (e.g., EEPROM semiconductor chips), nanotechnology memory, biological memory, or other data storage media. Alternatively, computer implemented instructions, data structures, screen displays, and other data under aspects of the present disclosure may be distributed over the Internet and/or over other networks (including wireless networks), on a propagated signal on a propagation medium (e.g., an electromagnetic wave(s), a sound wave, etc.) over a period of time, and/or they may be provided on any analog or digital network (packet switched, circuit switched, or other scheme).

Program aspects of the technology may be thought of as "products" or "articles of manufacture" typically in the form of executable code and/or associated data that is carried on or embodied in a type of machine-readable medium.

It will be apparent to those skilled in the art that various modifications and variations can be made to the disclosed method and system without departing from the scope of the disclosure. Other embodiments of the method and system will be apparent to those skilled in the art from consideration of the specification and practice of the method and system disclosed herein. It is intended that the specification and examples be considered as exemplary only, with a true scope of the disclosure being indicated by the following claims and their equivalents.

What is claimed is:

1. A method for adjusting a valve lash in an internal combustion engine, the method comprising:

receiving a first signal generated by a sensor secured to the internal combustion engine, the first signal being indicative of a closing of a valve;

receiving a second signal indicative of at least one of an engine speed of the internal combustion engine or a position of a camshaft of the internal combustion engine;

automatically determining an adjusted amount of lash associated with the valve based on the received first signal and the received second signal;

comparing the adjusted amount of lash to at least one predetermined threshold;

providing, in response to determining that the adjusted amount of lash is greater than the at least one predetermined threshold, a valve lash re-adjustment notification; and wirelessly transmitting the notification for inclusion as a part of a service maintenance record for the internal combustion engine.

2. The method of claim 1, wherein the first signal is a vibration signal.

3. The method of claim 1, wherein the second signal is an engine status signal indicative of the engine speed of the internal combustion engine.

4. The method of claim 1, wherein comparing the adjusted amount of lash comprises comparing the adjusted amount of lash to a first predetermined threshold and a second predetermined threshold.

5. The method of claim 4, wherein the first predetermined threshold corresponds to a need to correct the adjusted valve lash, and the second predetermined threshold corresponds to a need to discontinue operation of the internal combustion engine.

6. The method of claim 1, further comprising:

providing, in response to determining that the adjusted amount of lash is not greater than the at least one predetermined threshold, a notification indicating that the adjusted amount of lash is acceptable.

7. The method of claim 1, further comprising:

receiving respective vibration signals from a plurality of sensors associated with respective ones of the plurality of individual cylinders.

8. The method of claim 1, wherein receiving the second signal includes receiving the engine speed and the position of the camshaft of the internal combustion engine from an engine control module.

9. A system for adjusting a valve lash in an internal combustion engine, comprising:

at least one processor; and at least one non-transitory computer readable medium storing instructions which, when executed by the one or more processors, cause the one or more processors to perform operations comprising:

receiving a first signal generated by a sensor secured to the internal combustion engine, the first signal being indicative of a closing of a valve;

receiving a second signal indicative of at least one of an engine speed of the internal combustion engine or a position of a camshaft of the internal combustion engine;

automatically determining an adjusted amount of lash associated with the valve based on the received first signal and the received second signal;

comparing the adjusted amount of lash to at least one predetermined threshold; and providing, in response to determining that the adjusted amount of lash is greater than the at least one predetermined threshold, a valve lash re-adjustment notification, wherein comparing the adjusted amount of lash comprises comparing the adjusted amount of lash to a first predetermined threshold and a second predetermined threshold, wherein the first predetermined threshold corresponds to a need to correct the adjusted valve lash, and the second predetermined threshold corresponds to a need to discontinue operation of the internal combustion engine.

10. The system of claim 9, wherein the first signal is a vibration signal.

11. The system of claim 9, wherein the second signal is an engine status signal.

12. The system of claim 9, the operations further comprising:

providing, in response to determining that the adjusted amount of lash is not greater than the at least one predetermined threshold, a notification indicating that the adjusted amount of lash is acceptable.

13. The system of claim 9, the operations further comprising:

automatically determining, by the at least one processor, an adjusted amount of lash associated with each of a plurality of individual cylinders.

14. A method for calibrating a valve lash in an internal combustion engine, the method comprising:

receiving a first signal indicative of a closing of a valve of the internal combustion engine following an adjustment in an amount of the valve lash in the internal combustion engine;

receiving a second signal indicative of at least one of an engine speed of the internal combustion engine or a position of a camshaft of the internal combustion engine;

determining a magnitude of the adjusted amount of valve lash based on at least the received first signal and the received second signal;

comparing the magnitude of the adjusted amount of valve lash to a lash adjustment map; and transmitting, based on the comparison between the magnitude of the adjusted amount of valve lash and the lash adjustment map, a valve lash re-adjustment notification, wherein the lash adjustment map includes at least a first predetermined threshold and a second predetermined threshold, wherein the first predetermined threshold corresponds to a need to modify the adjusted valve lash, and the second predetermined threshold corresponds to a need to discontinue operation of the internal combustion engine.

15. The method of claim 14, further comprising:

providing, in response to determining that the amount of lash is not greater than the at least one predetermined threshold, a notification indicating that the adjusted amount of lash is acceptable.

16. The method of claim 14, wherein the first signal is a vibration signal.

17. The method of claim 14, wherein the second signal is an engine status signal.

* * * * *